United States Patent [19]

Benson et al.

[11] 4,446,999

[45] May 8, 1984

[54] POWDER ACTUATED TOOL SAFETY GUARD RETENTION

[75] Inventors: John Benson, Sherwood; Harold L. Hanel, Portland, both of Oreg.

[73] Assignee: International Telephone and Telegraph Corporation, New York, N.Y.

[21] Appl. No.: 322,590

[22] Filed: Nov. 18, 1981

[51] Int. Cl.[3] ..... B25C 1/18

[52] U.S. Cl. ..... 227/11; 173/116

[58] Field of Search ..... 173/116; 227/11

[56] References Cited

U.S. PATENT DOCUMENTS 3,248,032 4/1966 Bochman, Jr. ..... 227/11 X

FOREIGN PATENT DOCUMENTS 211642 11/1957 Australia ..... 227/11

*Primary Examiner*—Frank T. Yost

*Attorney, Agent, or Firm*—James B. Raden; William J. Michals

[57] ABSTRACT

A tool for driving nails into hard surfaces wherein the driving power is provided by cartridges of explosive powder. A safety guard on the front end of the tool is retained on the barrel of the tool by a threaded nut. A retention member is provided for preventing the nut from loosening during operation of the tool, yet which allows the nut to be removed when desired for disassembly of the tool.

1 Claim, 2 Drawing Figures

POWDER ACTUATED TOOL SAFETY GUARD RETENTION

BACKGROUND OF THE INVENTION

The present invention relates generally to a powder actuated tool and, more specifically, to such a tool having a novel safety guard thereon.

A powder actuated tool of the type herein contemplated is designed to accept a nail at the forward end of the barrel and a cartridge at the breech end of the barrel. The tool is pressed against a work surface to release a safety mechanism and then fired. The spent cartridge is removed, a new nail placed in the barrel, a new cartridge placed in the cartridge chamber and the process is repeated. On some such tools a safety guard is provided on the end of the barrel to protect against flying material and thereby protect the operator and bystanders. The guard is retained on the barrel by a threaded nut. During repeated use of the tool, the nut may loosen, causing the guard to become disconnected from the barrel. It is the object of the present invention to provide means for preventing the nut from loosening thereby assuring that the guard will remain fixed to the barrel of the tool during operation of the tool, yet allows easy removal of the barrel during disassembly of the tool for repair or maintenance.

SUMMARY OF THE INVENTION

In accordance with the present invention, the retaining nut for the safety guard of a tool of the type described above is prevented from loosening during operation of the tool by providing blocking means on the safety guard which cooperates with the nut to prevent unthreading of the nut. Such blocking means is released from the nut when the safety guard is retracted on the barrel, thereby allowing the nut to be removed when it is desired to disassemble the tool.

DESCRIPTION OF THE PREFERRED EMBODIMENT

Figure 1:
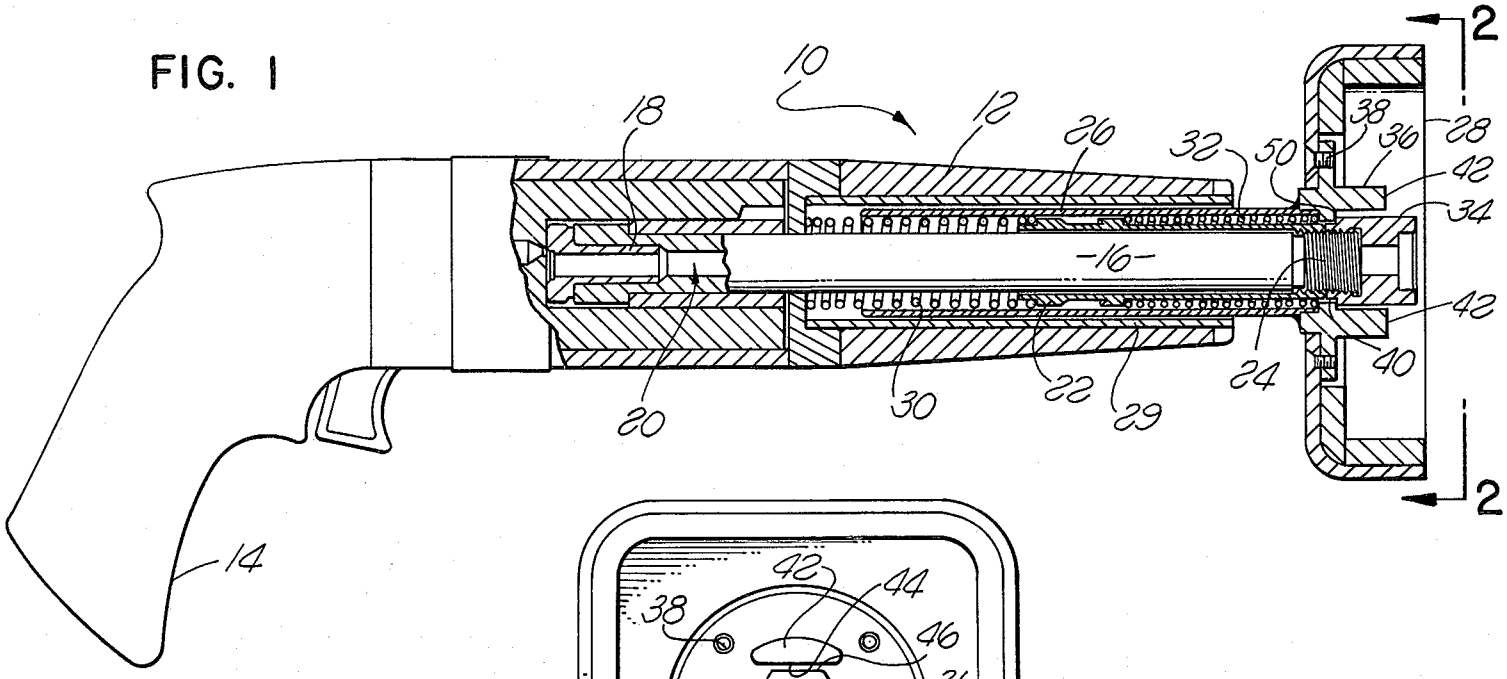
FIG. 1 is a partial longitudinal sectional view through the tool of the present invention.
Figure 2:
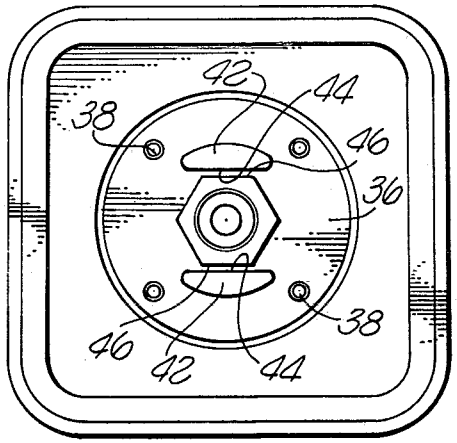
FIG. 2 is a front end view of the tool illustrated in FIG. 1 showing how the blocking means on the guard cooperates with the guard retaining nut.

Referring now to the drawing in detail, the tool of the present invention, generally designated 10, comprises a housing 12 having a handle 14. A barrel 16 is slidable in the housing. A breech plug 18 which receives a cartridge is mounted in the inner end of the bore 20 of the barrel. A nail, not shown, is mounted in the bore in front of the breech plug.

A sleeve 22 surrounds the forward portion of the barrel 16. The sleeve 22 is threadedly engaged with the threaded end 24 of the barrel. A second sleeve 26 surrounds the sleeve 22. A safety guard 28 is fixedly connected to the forward end of the sleeve 26. A third sleeve 29 surrounding sleeve 26 is fixed inside the housing 12. A spline connection or the like (not shown) is provided between sleeves 26 and 29 to prevent rotation of the tool housing relative to the safety guard. A coil spring 30 surrounding the barrel 16 engages the rear of the sleeve 22 to bias the barrel in the forward direction. A second coil spring 32 surrounding the sleeve 22 biases the safety guard 28 in the forward direction. A nut 34 is threaded onto the end 24 of the barrel to retain the guard 28 on the barrel.

Firing of the tool is accomplished by abutting the safety guard against a hard work surface and pushing against the surface to force the barrel rearwardly against the force of the spring 30. Rearward shifting of the barrel in the housing places the tool in its "cocked" position thereby allowing the trigger to fire the tool. The structure described so far is entirely conventional and constitutes no part of the present invention. Accordingly, no further details of the structure is deemed necessary for an understanding of the present invention, the description of which follows.

In accordance with the invention, an insert 36 is mounted centrally in the guard 28. The insert is fixed to the guard by a plurality of screws or rivets 38 and is fixed to the sleeve 26 by welding or the like. The insert has a central opening 40 therein through which the forward end 24 of the barrel extends.

Two forwardly extending lugs 42 are integrally formed on the insert 36 on opposite sides of the nut 34. The lugs have opposed flat surfaces 44 which are parallel to each other and spaced apart a distance slightly greater than the distance between the opposed flat surfaces 46 on the nut so that the respective pairs of surfaces 44 and 46 are in juxtaposition to each other.

With the nut installed on the end of the barrel and the barrel and the guard biased to their forward position as seen in FIG. 1, the flat surfaces 44 on the lugs cooperate with the flat surfaces 46 on the nut to prevent the nut from unthreading from the end of the barrel during operation of the tool in spite of the shocks imparted to the tool when it is fired.

To remove the nut 34 from the end of the barrel, the guard 28 is pushed rearwardly against the force of the spring 32 until the forward ends 48 of the lugs are positioned behind the shoulder 50. The nut may then be unthreaded so that the barrel may be removed from the assembly.

Thus, the present invention provides a simple and inexpensive means for assuring that the safety quard retaining nut on a powder actuated tool will not become inadvertently loosened or disconnected from the barrel of the tool during operation of the tool, yet which allows quick and simple removal of the retaining nut when it is desired to repair or maintain the tool.

What is claimed is:

1. A tool for explosively driving an elongated fastener into a work surface comprising:

a housing having a barrel mounted therein, said barrel having a threaded forward end;

a safety guard for said barrel having an opening through which said forward end extends, said guard being slidable between forward and rear positions on said barrel;

means biasing said guard into said forward position;

retaining means threadedly engaged with said forward end of said barrel for retaining said guard on said barrel and comprising a nut having opposed flat side surfaces thereon;

blocking means on said guard cooperating with said retaining means preventing unthreading thereof when said guard is in said forward position said blocking means comprising an annular insert member removably mounted to said guard concentric to said opening and engaging the inwardly surface of said nut and including a pair of forwardly projecting lugs on said insert member on opposite sides of said nut each having an inner flat surface positioned in juxtaposition to a corresponding one of said side surfaces; and said blocking means being released from said retaining means when said quard is retracted to said rear position thereby allowing unthreading of said retaining means from said barrel.

* * * * *